United States Patent [19]

Penninger et al.

[11] Patent Number: 4,751,324

[45] Date of Patent: Jun. 14, 1988

[54] BENZOYL ALANINE COMPOUNDS AND THEIR USE AS CORROSION INHIBITORS

[75] Inventors: Josef Penninger, Hilden; Karl H. Schmid, Mettmann; Juergen Geke, Duesseldorf, all of Fed. Rep. of Germany

[73] Assignee: Henkel Kommanditgesellschaft auf Aktien, Duesseldorf, Fed. Rep. of Germany

[21] Appl. No.: 874,255

[22] Filed: Jun. 13, 1986

[30] Foreign Application Priority Data

Jun. 13, 1985 [DE] Fed. Rep. of Germany ..... 3521116

[51] Int. Cl.[4] ..... C07C 101/34

[52] U.S. Cl. ..... 562/444; 562/443; 252/392

[58] Field of Search ..... 562/443, 444

[56] References Cited

U.S. PATENT DOCUMENTS

| | | | |
|---|---|---|---|
| 3,488,737 | 1/1970 | Gordon | 562/444 |
| 3,517,057 | 6/1970 | Pines et al. | 562/443 |
| 3,766,261 | 10/1973 | Finley | 562/443 |
| 3,846,470 | 11/1974 | Raabe et al. | 562/444 |
| 4,207,285 | 6/1980 | Oppenlaender et al. | 422/16 |

FOREIGN PATENT DOCUMENTS

| | | | |
|---|---|---|---|
| 0163107 | 8/1985 | European Pat. Off. | 562/444 |
| 1149843 | 12/1958 | Fed. Rep. of Germany | 252/394 |
| 1097990 | 1/1959 | Fed. Rep. of Germany | 562/444 |
| 1298670 | 7/1969 | Fed. Rep. of Germany | 252/394 |
| 2943963 | 10/1979 | Fed. Rep. of Germany | 252/394 |

OTHER PUBLICATIONS

Kato et al., Chem. Abst.; vol. 67, #63985d, (1967).
Nozaka et al., Chem. Abst.; vol. 67, #99836f, (1967).
Ceriani et al., Ann. de Chim., vol. 63, pp. 457–466, (1973).
Cromwell et al., J. Org. Chem., vol. 23, pp. 1327–1329, (1959).
Winnacker-Kuechler, Chemische Technologie, C. Hanser-Verlag, Munich, (1960), p. 199.
European Search Report.
Chemical Abstract, #129191e, vol. 89, Oct. 1978, pp. 163–166.
Chemical Abstract, #108,473x, vol. 80, May 1974, pp. 311–327.

*Primary Examiner*—James H. Reamer
*Attorney, Agent, or Firm*—Ernest G. Szoke; Henry E. Millson, Jr.; Mark A. Greenfield

[57] ABSTRACT

Benzoyl alanines having the formula:

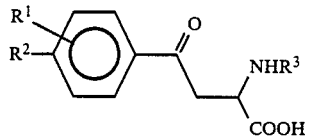

in which the symbols $R^1$ and $R^2$ (a) both represent hydrogen or (b) both represent a straight-chain or branched chain alkyl residue having from 1 to about 6 carbon atoms, or (c) $R^1$ represents hydrogen and $R^2$ represents a straight-chain or branched chain alkyl residue having from 1 to about 6 carbon atoms and in which the symbol $R^3$ represents a $C(CH_3)_m(CH_2OH)_{3-m}$ moiety wherein the symbol m represents an integer of from 0 to 3 and alkali metal and ammonium salts thereof, are disclosed.

The compounds are useful as corrosion-inhibitors for metals in aqueous systems.

11 Claims, No Drawings

BENZOYL ALANINE COMPOUNDS AND THEIR USE AS CORROSION INHIBITORS

BACKGROUND OF THE INVENTION

1. Field of the Invention

The invention relates to benzoyl alanines and to the use thereof as corrosion inhibitors in aqueous systems.

2. Description of Prior Art

Corrosion problems quite often occur in numerous industrial processes where aqueous media comes into contact with metallic surfaces such as iron, copper, aluminum, zinc and the various alloys thereof. Examples of such processes are cleaning processes in which aqueous industrial cleaning solutions are used; cooling processes in which water-containing coolant systems are employed; and processes involving cooling and simultaneous lubrication in machining metals.

In published German Patent Application No. 11 49 843, the use of semi-amides of maleic acid or succinic acid are disclosed as useful as additives for fuel or lubricant oils. However, these compounds have one drawback since in most cases, they are not water-soluble and since homogeneous dispersion thereof in the process liquid cannot be assured.

The U.S. Pat. No. 4,207,285 also discloses semi-amides of maleic acid as corrosion inhibitors for aqueous systems. The alkyl groups attached to the amide nitrogen atom in such compounds contain from 9 to 12 carbon atoms. The resulting amide acids are neutralized with mono-, di- or trialkanol amides or mixtures thereof.

In addition, corrosion inhibitors which have been proposed for iron in alkaline media include alkenyl succinic acids (published German Patent Application No. 29 43 963; Chemical Abstracts 95: 101406d), long-chain sulfonamidocarboxylic acids (published German Patent Application No. 12 98 670; Chemical Abstracts 71: 72064n), acyl sarcosinates (Winnacker-Kuechler, Chemische Technologie, C.-Hanser-Verlag, Munich (1960), page 199) or alkali metal benzoates. In the past fatty amines or amidazolines have been used primarily for iron corrosion inhibition in weakly acidic media. However, fully satisfactory results were not attainable.

Alkali metal silicates or alkali metal benzoates have been used as corrosion inhibitors for aluminum in alkaline media. However, the results attained using such components have not been generally satisfactory. A particular disadvantage inherent in the use of those compounds is that they are effective only in very high concentrations.

The use of corrosion inhibitors of the type heretofore mentioned not only provides inadequate protection from corrosion but also causes a number of problems in their practical application. For example, undesired heavy foaming of the compounds occurs in aqueous solutions and poor water-solubility and/or poor stability to water hardness or inadequate stability during storage restricts greatly the practical utility of some of the aforementioned compounds. Additionally, attention has to be directed to the toxicity of the compounds which often is excessively high, and to their extremely poor biodegradability.

In U.S. patent application Ser. No. 713,123, filed Mar. 18, 1985, and incorporated herein by reference, the use of certain benzoyl alanines as corrosion inhibitors for aqueous systems is disclosed. The benzoyl alanines in question exhibit excellent anticorrosive properties as well as high water-solubility and low foaming characteristics. However, the compounds disclosed in said patent application are disadvantageous in that they are unduly sensitive to changes of the process water hardness and manifest a lack of sufficient temperature stability.

DESCRIPTION OF THE INVENTION

It has now surprisingly been found that aqueous systems having excellent anti-corrosive properties, and low sensitivity to water hardness and very desirable temperature stability are obtained by using as corrosion inhibitors, novel benzoyl alanines having the general formula

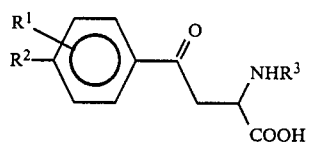

(I)

wherein the symbols $R^1$ and $R^2$:

(a) both represent hydrogen; or (b) both independently represent a straight-chain or branched alkyl residue having from 1 to about 6 carbon atoms; or where the symbol (c) $R^1$ represents hydrogen and $R^2$ represents a straight-chain or branched alkyl residue having from 1 to about 6 carbon atoms;

and wherein the symbol $R^3$ represents a moiety $-C(CH_3)_m(CH_2OH)_{3-m}$, in which m is an integer of from 0 to 3. The inventive compounds also include the alkali salts thereof and ammonium salts thereof, for example salts with ammonia, or mono-, di- or triethanolamine.

The present invention further encompasses the use of the compounds having the general formula (I), wherein $R^1$, $R^2$ and $R^3$ are as defined above, and of the alkali salts and the ammonium salts thereof as corrosion inhibitors in aqueous systems.

As corrosion inhibitors, those compounds having the general formula (I) wherein $R^1$ is hydrogen or methyl and $R^2$ is an alkyl residue having from 1 to about 4 carbon atoms, are particularly well suited for use. Preferred $R^2$ alkyl substituents are methyl, ethyl, isopropyl and tert-butyl.

The benzoyl alanines of this invention are prepared by generally known methods. For example, they can advantageously be synthesized in high yields by the Friedel-Crafts acylation of benzene or alkyl benzenes with maleic anhydride, followed by the addition of appropriate amines to the double bond of the 3-benzoylacrylic acids obtained in the first reaction step. The route of this synthesis is shown by the following reaction scheme:

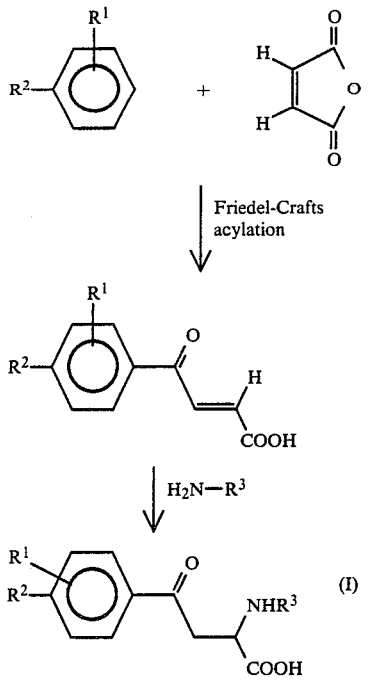

The alkali salts or ammonium salts, that are the ammonia, mono-, di- and triethanolamine salts of the compounds having the general formula (I), prepared in accordance with the above reaction scheme, are formed by neutralization with aqueous solutions of an alkali metal hydroxide or of a mono-, di- or triethanolamine, respectively.

For use as anticorrosive agents the benzoyl alanines of this invention may be used alone or in admixtures with other such compounds in any appropriate ratio. The compounds exert their beneficial effects in aqueous solutions, dispersions or emulsions. The present compounds are highly efficacious even when used at a low concentration, for example, at from about 0.01% to about 1.0% by weight, based on the weight of the aqueous solution. Thus, for example, in order to protect iron surfaces from corrosion in alkaline media, an amount of 0.5 $kg \cdot m^{-3}$ is sufficient for obtaining a high protection effect by the anticorrosive agent. In contrast thereto, conventional inhibitors have to be applied at a concentration of from 2.5 to 10 $kg \cdot m^{-3}$.

At the concentrations used in the actual practice of the invention, the specific benzoyl alanines according to the present invention are extremely water-soluble; characterized by low foaming attributes, and are extremely stable in storage. Particularly remarkable is their stability against water hardness and, in this respect, the compounds of the invention surpass the water hardness stability of all other known compounds and, as such, are suitable for use in protecting against corrosion. Therefore, the compounds of the invention can be used as a corrosion inhibitor in aqueous systems of any nature, e.g. in water-based cleaners, lubricants, for coolant circulation systems, hydraulic liquids, etc.

In order to prepare the aqueous systems containing the compounds of this invention as corrosion inhibitors, compounds having the general formula (I) or alkali salts or ammonium salts thereof are dissolved directly, by well known methods, in the aqueous system. In the alternative, they are added to the aqueous system in the form of aqueous concentrates manifesting good water dispersibility and outstanding storage stability.

For a fuller understanding of the nature and objects of this invention, reference may be had to the following examples which are given as further illustrations of the invention and are not to be construed in a limiting sense. The anticorrosive properties of the products disclosed in the examples were determined by the analysis of mass reduction in accordance with German Industrial Norm (DIN) 50,905/1-4 or by the filter paper test in accordance with DIN 51,360/2.

EXAMPLES

Example 1

In this example, 1 mol of maleic anhydride, dissolved in 300 ml of 1,2-dichlorethane, was added portionwise to 2 mols of aluminum chloride at a temperature of 20° C., with cooling, over a thirty minute period. The reaction mixture was then stirred for an additional 15 minute period. Thereafter, 1 mol of an appropriate alkylbenzene ($R_1$ and $R_2$ in the alkylbenzene used being as shown in the table which follows) was added, drop by drop, over a 45 minute period to the reaction mixture at a temperature of 20° C., with cooling. The mixture was stirred for an additional 60 minute period following which it was poured into an ice water-sulfuric acid mixture and extracted with ether.

The ether phases were combined and mixed with 1 mol of an appropriate amine (the amine used was characterized by the $R^3$ group shown in the table which follows). The mixture was stirred for about two hours at a temperature of 20° C. The precipitated benzoyl alanine, thus produced (see table which follows), was filtered under suction, dried and recrystallized from water ethanol.

The product was then converted into a salt by stirring it, in water, with an excess of analkali liquor or an alkanolamine, optionally with light heating.

The table which follows indicats the compounds produced by this process and the melting points thereof.

TABLE 1

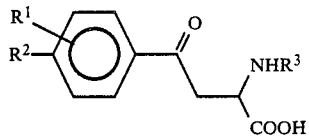

| Example 1 | $R^1$ | $R^2$ | $R^3$ | Melting Point °C. |
|---|---|---|---|---|
| (a) | H | $C_2H_5$ | $C(CH_3)_2CH_2OH$ | 112 |
| (b) | $CH_3$ | $CH_3$ | $C(CH_3)_2CH_2OH$ | 125 |
| (c) | H | $(CH_3)_3C$ | $C(CH_3)_2CH_2OH$ | 142 |
| (d) | H | $(CH_3)_2CH$ | $C(CH_3)(CH_2OH)_2$ | 143 |
| (e) | H | $CH_3$ | $C(CH_3)(CH_2OH)_2$ | 170 |
| (f) | H | $CH_3$ | $C(CH_2OH)_3$ | 158 |
| (g) | H | $CH_3$ | $C(CH_3)_3$ | 179 |
| (h) | H | $CH_3$ | $C(CH_3)_2CH_2OH$ | 163 |

Example 2

Mass Reduction Test: Three metal strips (unalloyed steel) having the dimensions of 80 mm×15 mm×1 mm which had been carefully pre-treated and weighed were each hung in a 1 liter vessel and immersed in a mixture of 800 ml of corrosive water, 50 ml of a buffer solution and a definedamount of a compound to be tested and were allowed to remain therein at room temperature for 3 hours. The solution was stirred at a speed of 80 rpm.

The water used as the corrosive medium was prepared in accordance with DIN 51360/2 and buffered to a pH of 9.0 with ammonia/ammonium chloride.

After the expiration of the test period, the metal strips were dried and weighed again. From the weight loss, the anticorrosive value S, based on a blank experiment, was calculated in accordance with the follwing equation $$S = 100\,(1 - a/b)$$

wherein a represents the weight loss of the test specimen and b represents the weight loss of the specimen in the blank test.

The results of the mass reduction test are shown in the following Table 2:

TABLE 2

Determination of the anticorrosive properties of compounds having the formula

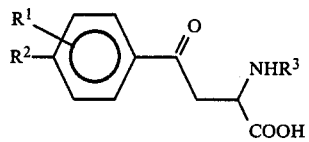

(I)

by the mass reduction test:

| Example 1 | $R^1$ | $R^2$ | $R^3$ | Anticorrosive Value S 1.0 | 0.1 | 0.05 |
|---|---|---|---|---|---|---|
| | | | | Inhibitor Concentration in % by weight | | |
| (a) | H | $C_2H_5$ | $C(CH_3)_2CH_2OH$ | 99 | 99 | 63 |
| (b) | $CH_3$ | $CH_3$ | $C(CH_3)_2CH_2OH$ | 98 | 83 | 75 |
| (c) | H | $(CH_3)_3C$ | $C(CH_3)_2CH_2OH$ | 99 | 93 | 82 |
| (d) | H | $(CH_3)_2CH$ | $C(CH_3)(CH_2OH)_2$ | 99 | 99 | 94 |
| (e) | H | $CH_3$ | $C(CH_3)(CH_2OH)_2$ | 97 | 90 | 63 |
| (f) | H | $CH_3$ | $C(CH_2OH)_3$ | 97 | 90 | 66 |
| (g) | H | $CH_3$ | $C(CH_3)_3$ | 98 | 90 | 54 |
| (h) | H | $CH_3$ | $C(CH_3)_2CH_2OH$ | 99 | 93 | 75 |
| Comparison | Sodium benzoate | | | 93 | 18 | 0 |
| | Maleic acid mono-2-ethylhexylamide | | | 91 | 0 | 0 |
| | Benzenesulfonamido caproic acid | | | 90 | 0 | 0 |

Example 3

Gray Cast Iron Casting-Filter Paper Test:

The gray cast iron casting filter paper test was carried out by the standard method in accordance with DIN 51360/2. Water having a hardness of 20° d was used as the test medium in compliance with the DIN prescription. The claimed compounds were tested in the form of their diethanolamine salts (pH 9.7).

The results were evaluated in accordance with the above-identified DIN Standard by means of the following scale of degrees of corrosion:

0=No corrosion;

1=Traces of corrosion;

2=Slight corrosion;

3=Moderate corrosion; and

4=Heavy corrosion.

The test results are set forth in Table 3.

TABLE 3

Determination of the anticorrosive properties of compounds having the formula

| | $R^1$ | $R^2$ | $R^3$ | Anticorrosive Value S 0.375 | 0.250 | 0.125 |
|---|---|---|---|---|---|---|
| | | | | Inhibitor Concentration in % by weight | | |
| Example 1 | | | | | | |
| (a) | H | $C_2H_5$ | $C(CH_3)_2CH_2OH$ | 0 | 0 | 3 |
| (b) | $CH_3$ | $CH_3$ | $C(CH_3)_2CH_2OH$ | 0 | 0 | 3 |
| (c) | H | $(CH_3)_3C$ | $C(CH_3)_2CH_2OH$ | 0 | 0 | 3 |
| (d) | H | $(CH_3)_2CH$ | $C(CH_3)(CH_2OH)_2$ | 0 | 0 | 2 |
| (e) | H | $CH_3$ | $C(CH_3)(CH_2OH)$ | 0 | 0 | 4 |
| (f) | H | $CH_3$ | $C(CH_2OH)_3$ | 0 | 0 | 4 |
| (g) | H | $CH_3$ | $C(CH_3)_3$ | 0 | 0 | 3 |
| (h) | H | $CH_3$ | $C(CH_3)_2CH_2OH$ | 0 | 0 | 2 |
| Comparison | Caprylic acid | | | 3 | 3 | 4 |
| | Maleic acid mono-2-ethylhexyl-amide | | | 0 | 1 | 3 |
| | Benzenesulfonamido caproic acid | | | 1 | 1 | 3 |

Example 4

Test for Sensitivity to Water Hardness:

Solutions each containing 10 grams of the compounds listed in Table 4 having the general formula (I) in 1 liter of hard water (DIN 51360) were stirred while being maintained at a temperature of 70° C. for 120 hours. When no precipitations were observed after this period, the solutions were rated (+). When precipitation occurred after 120 hours or after 1 hour, the ratings were assigned as (−) and (− −), respectively.

Benzoyl alanines disclosed in U.S. patent application, Ser. No. 713,123, filed Mar. 18, 1985, were employed for comparison purposes. The results are shown in the following Table 4.

TABLE 4

Test for Sensitivity to Water Hardness.

| | $R^1$ | $R^2$ | $R^3$ | Sensitivity to water hardness |
|---|---|---|---|---|
| Example 1 | | | | |
| (b) | $CH_3$ | $CH_3$ | $C(CH_3)_2CH_2OH$ | + |
| (h) | H | $CH_3$ | $C(CH_3)_2CH_2OH$ | + |
| (a) | H | $C_2H_5$ | $C(CH_3)_2CH_2OH$ | + |
| (c) | H | $(CH_3)_3C$ | $C(CH_3)_2CH_2OH$ | + |
| (d) | H | $(CH_3)_2CH$ | $C(CH_3)(CH_2OH)_2$ | + |
| (f) | H | $CH_3$ | $C(CH_2OH)_3$ | + |
| (g) | H | $CH_3$ | $C(CH_3)_3$ | + |
| Comparison | H | $(CH_3)_2CH$ | $CH_2CH_2OH$ | − |
| | H | $CH_3$ | $CH(CH_3)_2$ | − |
| | H | $C_2H_5$ | $(CH_2)_3CH_3$ | − − |

Example 5

Test for Temperature Stability:

Aqueous solutions of compounds having the general formula (I) containing 12.5% of active substance and 37.5% of diethanolamine with the balances water to 100% were stirred while maintained at a temperature of 80° C. for four weeks.

Solutions showing no change in color or decrease in activity after four weeks were rated (+). Solutions which had blackened after four weeks or after one week were rated (−) and (− −) respectively.

Benzoyl alanines disclosed on U.S. patent application, Ser. No. 713,123, filed Mar. 18, 1985, were employed for comparison purposes.

The results are shown in the following Table 5.

TABLE 5

| | Test for temperature stability. | | | |
|---|---|---|---|---|
| | $R^1$ | $R^2$ | $R^3$ | Stability |
| Example 1 | | | | |
| (b) | $CH_3$ | $CH_3$ | $C(CH_3)_2CH_2OH$ | + |
| (h) | H | $CH_3$ | $C(CH_3)_2CH_2OH$ | + |
| (e) | H | $CH_3$ | $C(CH_3)(CH_2OH)_2$ | + |
| (f) | H | $CH_3$ | $C(CH_2OH)_3$ | + |
| (g) | H | $CH_3$ | $C(CH_3)_3$ | + |
| (d) | H | $(CH_3)_2CH$ | $C(CH_3)(CH_2OH)_2$ | + |
| Comparison | H | $(CH_3)_2CH$ | $CH_2CH_2OH$ | −− |
| | $CH_3$ | $CH_3$ | $(CH_2)_3N(CH_3)_2$ | −− |
| | $CH_3$ | $CH_3$ | $CH_2CH_3$ | − |
| | H | $CH_3CH_2$ | $(CH_2)_3CH_3$ | − |

What is claimed is:

1. Benzoyl alanines having the formula:

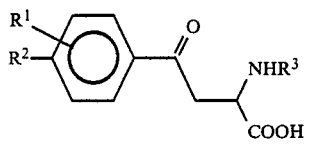

(I)

wherein the symbol $R^1$ and the symbol $R^2$ (a) both represent hydrogen, (b) both independently represent a straight-chain or branched chain alkyl residue having from 1 to about 6 carbon atoms or (c) the symbol $R^1$ represents hydrogen and $R^2$ represents a straight chain or branched chain alkyl residue having from 1 to about 6 carbon atoms and wherein the symbol $R_3$ represents a $—C(CH_3)_m(CH_2OH)_{3-m}$ moiety in which the symbol m represents an integer of from 0 to 3 and alkali and ammonium salts thereof.

2. A benzoyl alanine according to claim 1 wherein $R^1$ is hydrogen and $R^2$ is a $CH_3$ group.

3. A benzoyl alanine according to claim 1 wherein $R^1$ is a $CH_3$ group and $R^2$ is a $CH_3$ group.

4. A benzoyl alanine according to claim 1 wherein $R^1$ is hydrogen and $R^2$ is a $C_2H_5$ group.

5. A benzoyl alanine according to claim 1 wherein $R^1$ is hydrogen and $R^2$ is a $(CH_3)_3C—$ group.

6. A benzoyl alanine according to claim 1 wherein $R^1$ is hydrogen and $R^2$ is a $(CH_3)_2CH—$ group.

7. The compound of claim 2 wherein $R^3$ is a $—C(CH_2OH)_3$, $—C(CH_3)_3$, $—C(CH_3)_2CH_2OH$ or $—C(CH_3)(CH_2OH)_2$ group.

8. The compound of claim 3 wherein $R^3$ is a $—C(CH_3)_2CH_2OH$ group.

9. The compound of claim 4 wherein $R^3$ is a $—C(CH_3)_2CH_2OH$ group.

10. The compound of claim 5 wherein $R^3$ is a $—C(CH_3)_2CH_2OH$ group.

11. The compound of claim 6 wherein $R^3$ is a $—C(CH_3)(CH_2OH)_2$ group.

* * * * *